US006618020B2

(12) United States Patent
Wang et al.

(10) Patent No.: US 6,618,020 B2
(45) Date of Patent: Sep. 9, 2003

(54) MONOPOLE SLOT ANTENNA

(75) Inventors: Hanyang Wang, Witney (GB); Ming Zheng, Farnborough (GB); Su Qing Zhang, Oxford (GB)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/020,195

(22) Filed: Dec. 18, 2001

(65) Prior Publication Data

US 2003/0112196 A1 Jun. 19, 2003

(51) Int. Cl.[7] ..... H01Q 13/10
(52) U.S. Cl. ..... 343/767
(58) Field of Search ..... 343/700 MS, 767, 343/770; H01Q 13/10

(56) References Cited

U.S. PATENT DOCUMENTS

| | | | | | |
|---|---|---|---|---|---|
| 4,843,403 | A | * | 6/1989 | Lalezari et al. | 343/767 |
| 5,563,617 | A | * | 10/1996 | Redfern et al. | 343/767 |
| 5,646,637 | A | * | 7/1997 | Miller et al. | 343/713 |
| 5,677,698 | A | * | 10/1997 | Snowdon | 343/770 |
| 6,031,503 | A | * | 2/2000 | Preiss et al. | 343/770 |
| 6,373,442 | B1 | * | 4/2002 | Thomas et al. | 343/767 |
| 6,414,642 | B2 | * | 7/2002 | Honda et al. | 343/702 |
| 6,480,162 | B2 | * | 11/2002 | Sabet et al. | 343/767 |

* cited by examiner

*Primary Examiner*—Tho Phan
(74) *Attorney, Agent, or Firm*—Antonelli, Terry, Stout & Kraus, LLP

(57) ABSTRACT

A monopole slot antenna is formed on a PCB as a slot with an open end at the edge of the PCB. The antenna is fed at its open end.

10 Claims, 4 Drawing Sheets

MONOPOLE SLOT ANTENNA

FIELD OF THE INVENTION

The present invention relates to a slot antenna.

BACKGROUND TO THE INVENTION

Slot antennas have found wide application in the field of radio communication. Conventional slot antennas comprise halfwave elements. This has put them at a disadvantage, with regard to size, compared with patch or wire antennas, such as the PIFA (planar inverted-F antenna), which can be constructed with quarterwave elements.

Ideally, a wire monopole antenna or the like comprises a quarterwave radiating element perpendicular to an infinite ground plane. This configuration is in practice impossible to achieve. However, in some circumstances, such as a mobile phone, it is impossible even to approximate this configuration well because of other design constraints.

SUMMARY OF THE INVENTION

An object of the present invention is to provide a slot antenna that is not at a size disadvantage to PIFA antennas.

According to the present invention, there is provided a resonant monopole slot antenna including a radiating slot which is dimensioned such that the slot is equivalent electromagnetically to an odd number of quarter wavelengths at the antenna's operating frequency, wherein the antenna's feed is arranged at the open end of the radiating slot. Feeding the slot at it open end provides a broader usable bandwidth than feeding at a position towards the closed end.

The radiating slot may be straight or not straight. If the slot is not straight, it may be, for example, L-shaped or meander.

Preferably, said odd number is 1.

Preferably, the radiating slot comprises an area of a printed circuit board which is free of conductor. More preferably, said area extends to an edge of the printed circuit board.

Preferably, said feed comprises a conductor extending transversely across the radiating slot at its open end. More preferably, said conductor comprises a signal line of a stripline or microstrip transmission line.

DETAILED DESCRIPTION OF THE PREFERRED EMBODIMENT

Preferred embodiments of the present invention will now be described, by way of example only, with reference to the accompanying drawings.

Figure 1A:
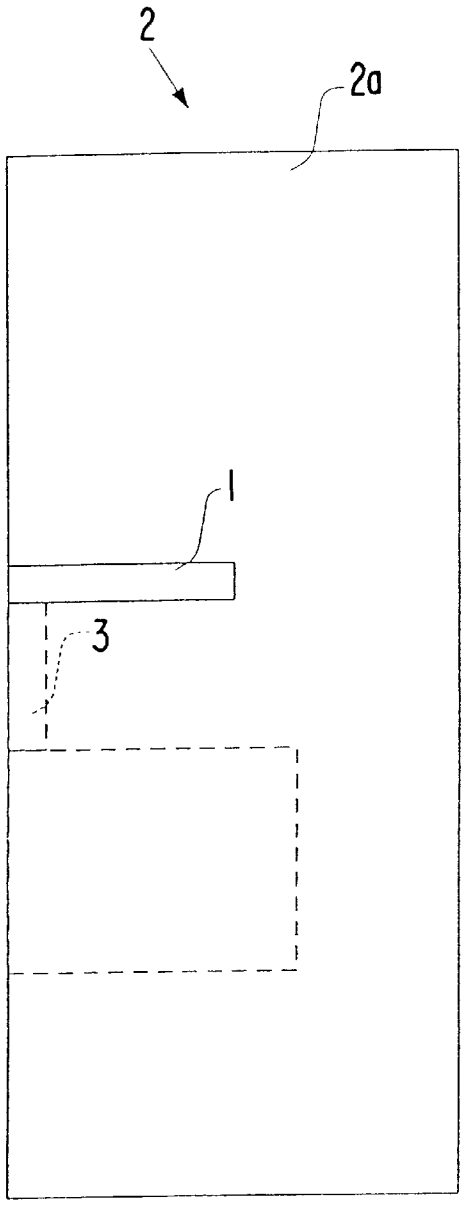
FIGS. 1(*a*) and 1(*b*) show the front and back, respectively, of a PCB carrying a first antenna according to the present invention.
Figure 1B:
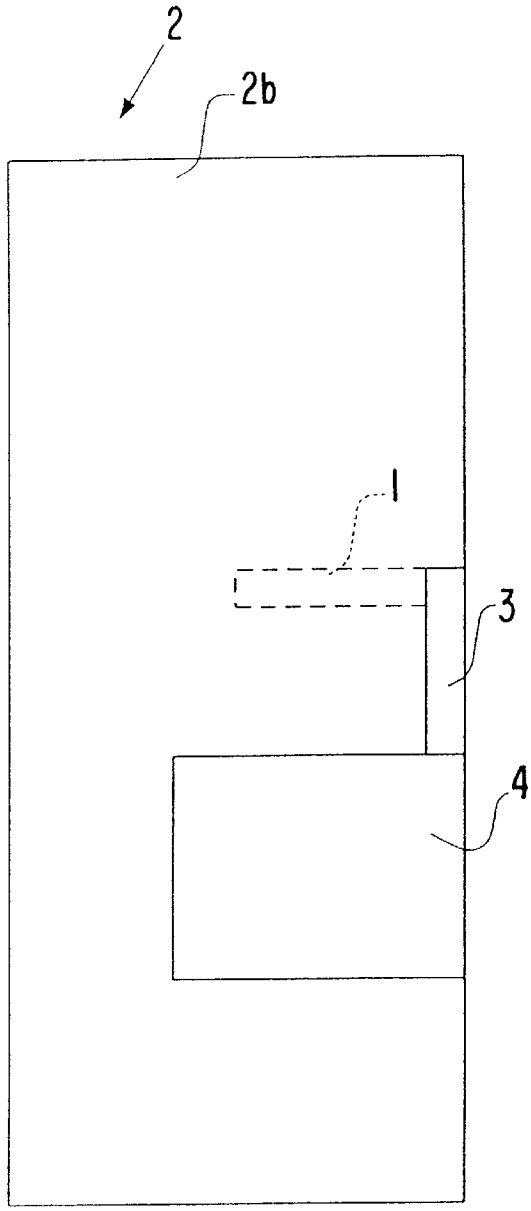

Referring to FIGS. 1(*a*) and 1(*b*), a slot antenna 1 is formed on a double sided printed circuit board 2. The slot antenna 1 is formed by removing a strip of copper from a margin of the front side 2*a* of the printed circuit board 2. The front side 2*a* of the printed circuit board 2 is otherwise an unbroken ground plane.

The back side 2*b* of the printed circuit board 2 is devoid of copper save for a microstrip feed 3 to the slot antenna 1 and the tracks of a radio transmitter circuit 4.

The slot antenna 1 is open at the edge of the printed circuit board 2. In the present example, the length of the slot antenna is 12 mm and its width is 2 mm and the slot antenna resonates at 2451 MHz. The is approximately the same resonant frequency that would be expected for a closed slot antenna 24 mm long and 2 mm wide. Such a closed slot antenna is analogous to a halfwave dipole wire antenna and the present antenna can be viewed as analogous to a quarterwave monopole wire antenna. Consequently, the dimensions of slots with hereinafter be referred to by reference to the analogous wire antenna length.

The microstrip feed 3 to the slot antenna 1 extends along the edge of the printed circuit board 2, perpendicular to the slot antenna 1. The microstrip feed 3 terminates behind the slot antenna 1. In this example, the microstrip feed 3 feeds the slot antenna 1 at its high impedance end. Feeding the antenna at the high impedance end in this way provides a good match over a larger bandwidth than can be achieved by feeding the slot at its low impedance end.

Figure 2A:
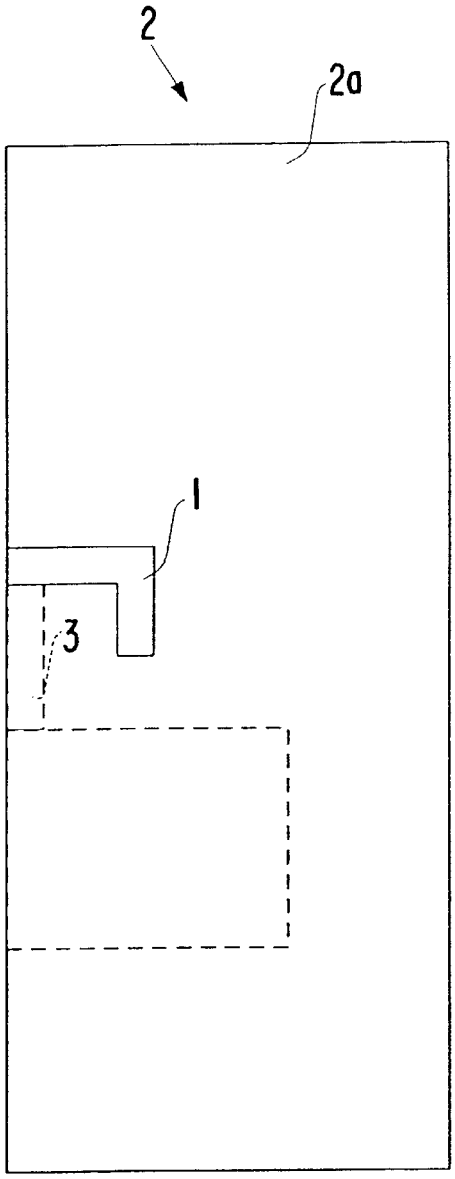
FIGS. 2(*a*) and 2(*b*) show the front and back, respectively, of a PCB carrying a second antenna according to the present invention.
Figure 2B:
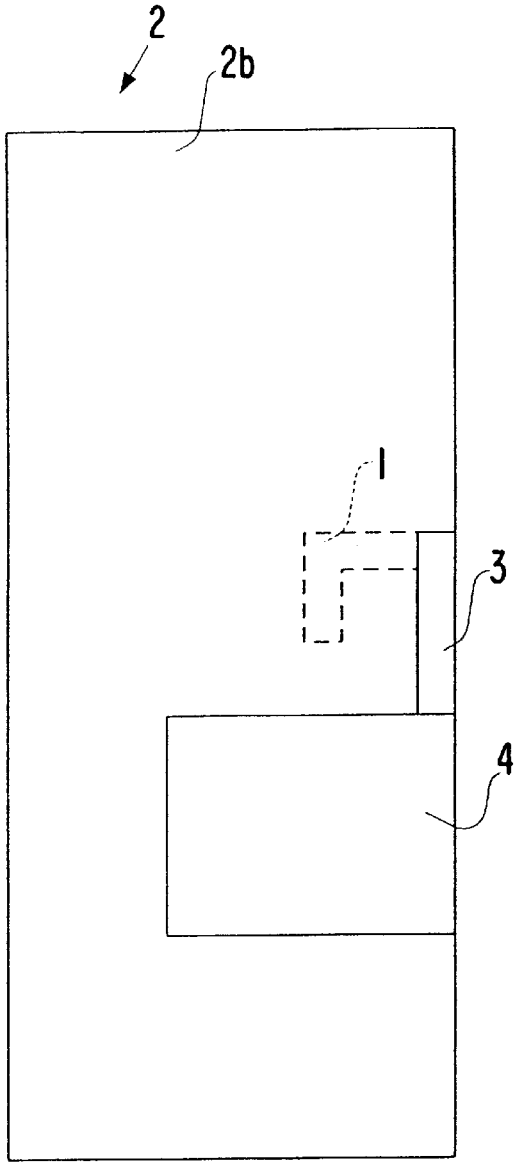

Referring to FIGS. 2(*a*) and 2(*b*), the straight slot of the antenna 1 of FIGS. 1(*a*) and 1(*b*) can be replaced by an L-shaped slot.

Figure 3A:
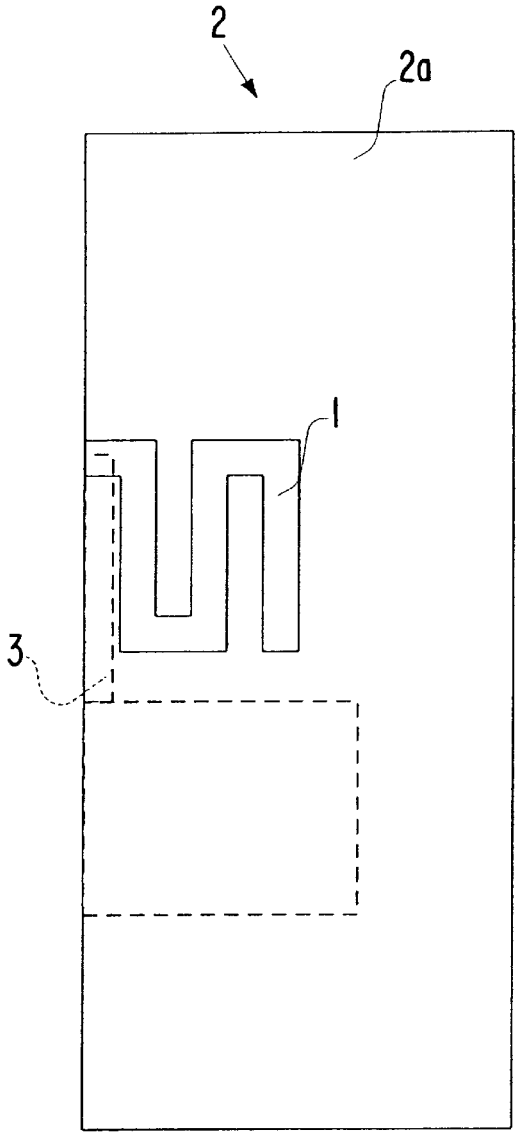
FIGS. 3(*a*) and 3(*b*) show the front and back, respectively, of a PCB carrying a third antenna according to the present invention.
Figure 3B:
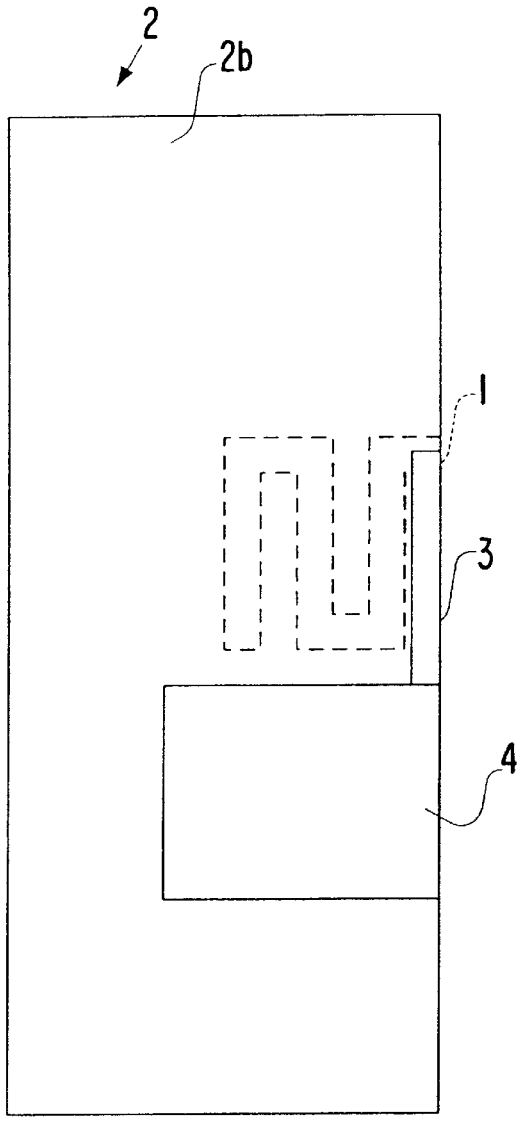

Referring to FIGS. 3(*a*) and 3(*b*), the straight slot of the antenna 1 of FIGS. 1(*a*) and 1(*b*) can be replaced by a meandering slot.

Figure 4B:
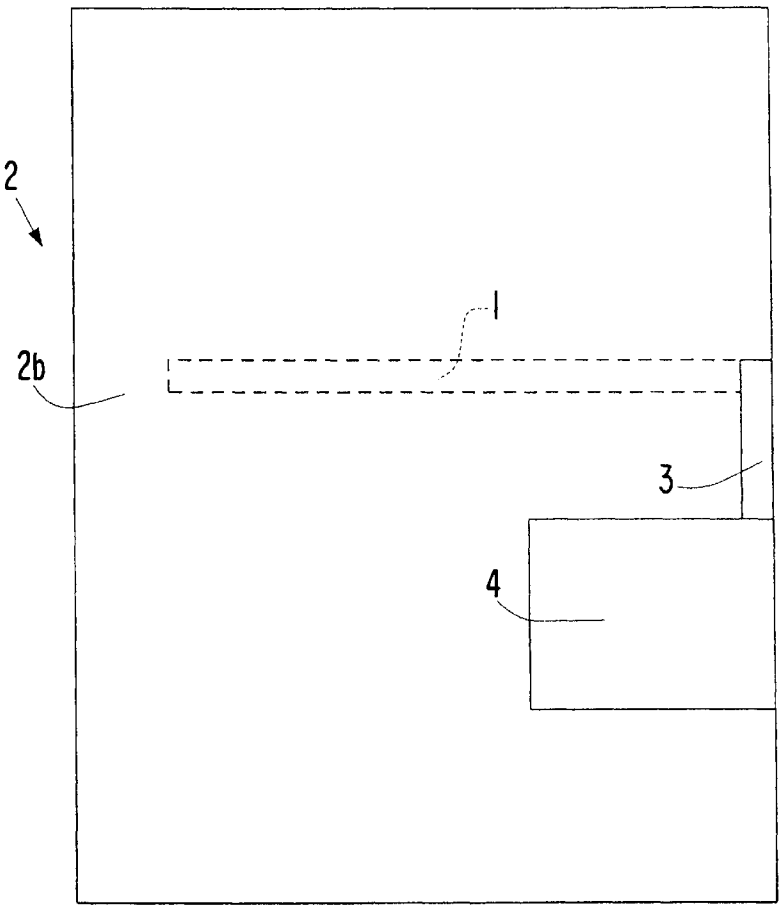
FIGS. 4(*a*) and 4(*b*) show the front and back, respectively, of a PCB carrying a fourth antenna according to the present invention.
Figure 4A:
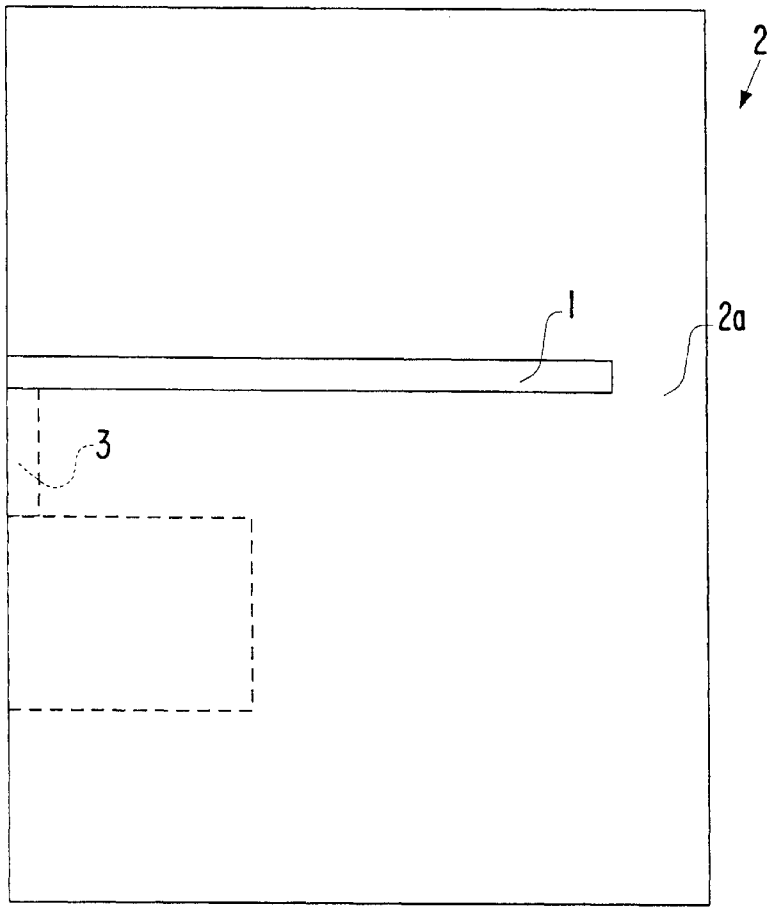

Referring to FIGS. 4(*a*) and 4(*b*), the "quarterwave" slot of the antenna 1 of FIGS. 1(*a*) and 1(*b*) can be extended by units of a "quaterwave", for instance to three "quarterwaves" as shown. With the feed point at the open end of the slot, the antennas feed impedance will be high for lengths which are odd numbers of "quarterwaves" and low for even numbers of "quarterwaves".

It will be appreciated that many modifications can be made to the above-described embodiments without departing from the spirit and scope of the claims appended hereto.

What is claimed is:

1. A resonant monopole slot antenna including a radiating slot with an open-end, which is dimensioned such that the slot is equivalent electromagnetically to an odd number of quarter wavelengths at the antenna's operating frequency, wherein the antenna's feed is arranged at the open-end of the radiating slot.

2. An antenna according to claim 1, wherein the radiating slot is straight.

3. An antenna according to claim 1, wherein the radiating slot is not straight.

4. An antenna according to claim 3, wherein said slot is L-shaped.

5. An antenna according to claim 3, wherein said radiating slot meanders.

6. An antenna according to claim 1, wherein said odd number is 1.

7. An antenna according to claim 1, wherein the radiating slot comprises an area of a printed circuit board which is free of conductor.

8. An antenna according to claim 7, wherein said area extends to an edge of the printed circuit board.

9. An antenna according to claim 1, wherein said feed comprises a conductor extending transversely across the radiating slot at its open end.

10. An antenna according to claim 9, wherein said conductor comprises a signal line of a stripline or microstrip transmission line.

* * * * *